US009819101B2

(12) United States Patent
Bury et al.

(10) Patent No.: US 9,819,101 B2
(45) Date of Patent: Nov. 14, 2017

(54) CONNECTION DEVICE FOR CONNECTING ELECTRICAL CONDUCTORS

(71) Applicant: Phoenix Contact GmbH Co. KG, Blomberg (DE)

(72) Inventors: Joachim Bury, Herford (DE); Thomas Salomon, Verl (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/033,727

(22) PCT Filed: Nov. 3, 2014

(86) PCT No.: PCT/EP2014/073562

§ 371 (c)(1),
(2) Date: May 2, 2016

(87) PCT Pub. No.: WO2015/063296

PCT Pub. Date: May 7, 2015

(65) Prior Publication Data

US 2016/0276756 A1 Sep. 22, 2016

(30) Foreign Application Priority Data

Nov. 4, 2013 (DE) ..... 10 2013 112 106

(51) Int. Cl.

| | |
|---|---|
| ***H01R 4/32*** | (2006.01) |
| ***H01R 9/24*** | (2006.01) |
| ***H01R 4/30*** | (2006.01) |

(52) U.S. Cl.
CPC ..... *H01R 9/2416* (2013.01); *H01R 4/301* (2013.01); *H01R 4/32* (2013.01); *H01R 9/24* (2013.01)

(58) Field of Classification Search
CPC ... H01R 4/4818; H01R 4/4836; H01R 4/4809
See application file for complete search history.

(56) References Cited

U.S. PATENT DOCUMENTS

| | | | |
|---|---|---|---|
| 1,993,391 | A | 3/1935 | Weaver |
| 2,312,240 | A | 2/1943 | Dibner |
| 4,375,311 | A | 3/1983 | Feldman |

(Continued)

FOREIGN PATENT DOCUMENTS

| | | | |
|---|---|---|---|
| DE | 561 436 | A | 9/1932 |
| DE | 697 227 | A | 9/1937 |

(Continued)

OTHER PUBLICATIONS

ISA/EP, International Search Report, Int'l Application No. PCT/EP2014/073562, Jan. 21, 2015, European Patent Office, Rijswijk, NL, 11 pgs.

*Primary Examiner* — Xuong Chung Trans
(74) *Attorney, Agent, or Firm* — Holland & Hart LLP

(57) ABSTRACT

A connection device for connecting electrical conductors includes a sheath clamp comprising a bottom part and a top part, a contact carrier to which the bottom portion of the sheath clamp is attached, and a detachable insulating cap configured for rotabably receiving the top part of the sheath clamp, wherein the detachable insulating cap is permanently connected to the contact carrier.

18 Claims, 6 Drawing Sheets

(56) References Cited

U.S. PATENT DOCUMENTS

| | | | | |
|---|---|---|---|---|
| 4,669,806 | A * | 6/1987 | Fuchs | H01R 4/363 439/712 |
| 5,167,526 | A * | 12/1992 | Pinyan | H01R 4/32 439/411 |
| 8,206,186 | B2 * | 6/2012 | Kisic | G01R 1/0408 439/482 |
| 2009/0088032 | A1 | 4/2009 | Keeven et al. | |

FOREIGN PATENT DOCUMENTS

| | | | |
|---|---|---|---|
| DE | 735175 | C | 5/1973 |
| DE | 103 39 670 | B4 | 2/2006 |
| FR | 2 215 713 | A1 | 1/1973 |
| FR | 2215713 | A1 | 8/1974 |
| WO | WO-9104590 | A1 | 4/1991 |
| WO | WO 2010/040702 | A1 | 4/2010 |

* cited by examiner

CONNECTION DEVICE FOR CONNECTING ELECTRICAL CONDUCTORS

CROSS-REFERENCE TO RELATED APPLICATION

The present application is a 373 national phase filing of International Application No. PCT/EP2014/073562, entitled "Connection Device for Connecting Electrical Conductors", filed Nov. 4, 2013, which claims priority to German Patent Application No. 10 2013 112 106.3, entitled "Anschlussvorrichtung zum Verbinden von elektrischen Leitern", filed Nov. 4, 2013.

BACKGROUND

In numerous cases, clamps for connecting electrical conductors are introduced in conductor direction into the clamping site. If, for space reasons, or due to the available handling space, filling of the clamping site is to take place from above, a sheath clamp that is open towards the top can be used for the insertion and batching of cut or uncut conductors. A closing of the clamping space and a firm securing of the conductors occurs by placement of the top part and tightening.

The advantage of the free and open accessibility is acquired at the cost of the disadvantage of a non-fixed and therefore detachable top part. The joining of the top part and the bottom part of the sheath clamp requires accuracy or multiple placement until the pressure piece is introduced into a yoke.

SUMMARY

The present disclosure relates to a connection device for connecting electrical conductors, which comprises a sheath clamp with a bottom part of the sheath clamp and a top part of the sheath clamp. Therefore, the aim of the present disclosure is to indicate a connection device with a sheath clamp that simplifies the connection of electrical conductors.

This aim is attained by a subject matter having the features according to the independent claim. Advantageous examples are the subject matter of the dependent claim, the description and the drawings.

According to a first set of examples, the aim is attained by a connection device for connecting electrical conductors, which comprises a sheath clamp with a bottom part of the sheath clamp and with a top part of the sheath clamp, with a contact carrier in which the bottom part of the sheath clamp is fastened; and a detachable insulating cap which is permanently connected to the contact carrier for rotatably receiving the top part of the sheath clamp. As a result, for example, the technical advantage is achieved that an introduction of electrical conductors from above into the sheath clamp is made possible and a detachment of the top part of the sheath clamp is prevented. Since the top part of the sheath clamp of the connection device remains within reach, the connection of the electrical conductors is simplified.

The connection device can be used in a functional component of automation technology, for example, in a component mounting system, in particular a field bus system.

In an advantageous example of the connection device, the insulating cap can be inserted into the contact carrier. As a result, for example, the technical advantage is achieved that an introduction of the top part of the sheath clamp into the contact carrier is simplified.

In an additional advantageous example of the connection device, the contact carrier comprises two opposite guide grooves for guiding the insulating cap inside the contact carrier. As a result, for example, the technical advantage is achieved that the insulating cap can be guided in a simple way to the provided position opposite the bottom part of the sheath clamp.

In an additional advantageous example of the connection device, the insulating cap comprises two guide sections for insertion into the opposite guide grooves of the contact carrier. As a result, for example, the technical advantage is achieved that a clamp-free guiding of the insulating cap to the bottom part of the sheath clamp is made possible.

In an additional advantageous example of the connection device, the insulating cap comprises a swivel arm for tiltable attachment of the insulating cap to the contact carrier. As a result, for example, the technical advantage is achieved that the insulating cap can be tilted to the side for the insertion of the electrical conductors.

In an additional advantageous example of the connection device, the swivel arm comprises two opposite pivots. As a result, for example, the technical advantage is achieved that the insulating cap is rotatably mounted in a reliable manner.

In an additional advantageous example of the connection device, the contact carrier comprises two pivot guide grooves for the slidable insertion of the insulating cap by means of the opposite pivots. As a result, for example, the technical advantage is achieved that the insulating cap: can be slid into the contact carrier and is tiltable in a pulled-out position.

In an additional advantageous example of the connection device, the insulating cap is attached by means of a flexible section to the contact carrier. As a result, for example, the technical advantage is achieved that a permanent attachment of the insulating cap is achieved in a simple way.

In an additional advantageous example of the connection device, the insulating cap comprises a pin for rotatable attachment of the insulating cap to the contact carrier, which extends parallel to the rotation axis of the top part of the sheath clamp. As a result, for example, the technical advantage is achieved that, in a pulled-out state, the insulating cap can be turned to the side about the axis of the pin.

In an additional advantageous example of the connection device, a metal contact bridge is attached to the insulating cap, for exerting a pressing force onto the electrical conductors. As a result, for example, the technical advantage is achieved that the contacting of the electrical conductors is improved.

In an additional advantageous example of the connection device, the metal contact bridge is attached to the guide sections. As a result, for example, the technical advantage is achieved that a stable attachment of the metal contact bridge can be achieved.

In an additional advantageous example of the connection device, the metal contact bridge overlaps the top part of the sheath clamp. As a result, for example, the technical advantage is achieved that a large pressing surface is produced.

In an additional advantageous example of the connection device, the top part of the sheath clamp comprises a peg for exerting a pressing force onto the metal contact bridge, which is arranged on the rotation axis of the top part of the sheath clamp. As a result, for example, the technical advantage is achieved that the pressing occurs uniformly over the entire pressing surface.

In an additional advantageous example of the connection device an electrically insulating contact protection element is arranged between a top side of the top part of the sheath clamp and the insulating cap. As a result, for example, the technical advantage is achieved that inadvertent contacting of the top part of the sheath clamp is prevented.

In an additional advantageous example of the connection device, the contact protection element comprises a slot for the insertion of a turning tool. As a result, for example, the technical advantage is achieved that the top part of the sheath clamp can be screwed in by means of a turning tool despite the contact protection element.

BRIEF DESCRIPTION OF THE DRAWINGS

Additional examples are explained in reference to the appended drawings, in which.

DETAILED DESCRIPTION

Figure 1:
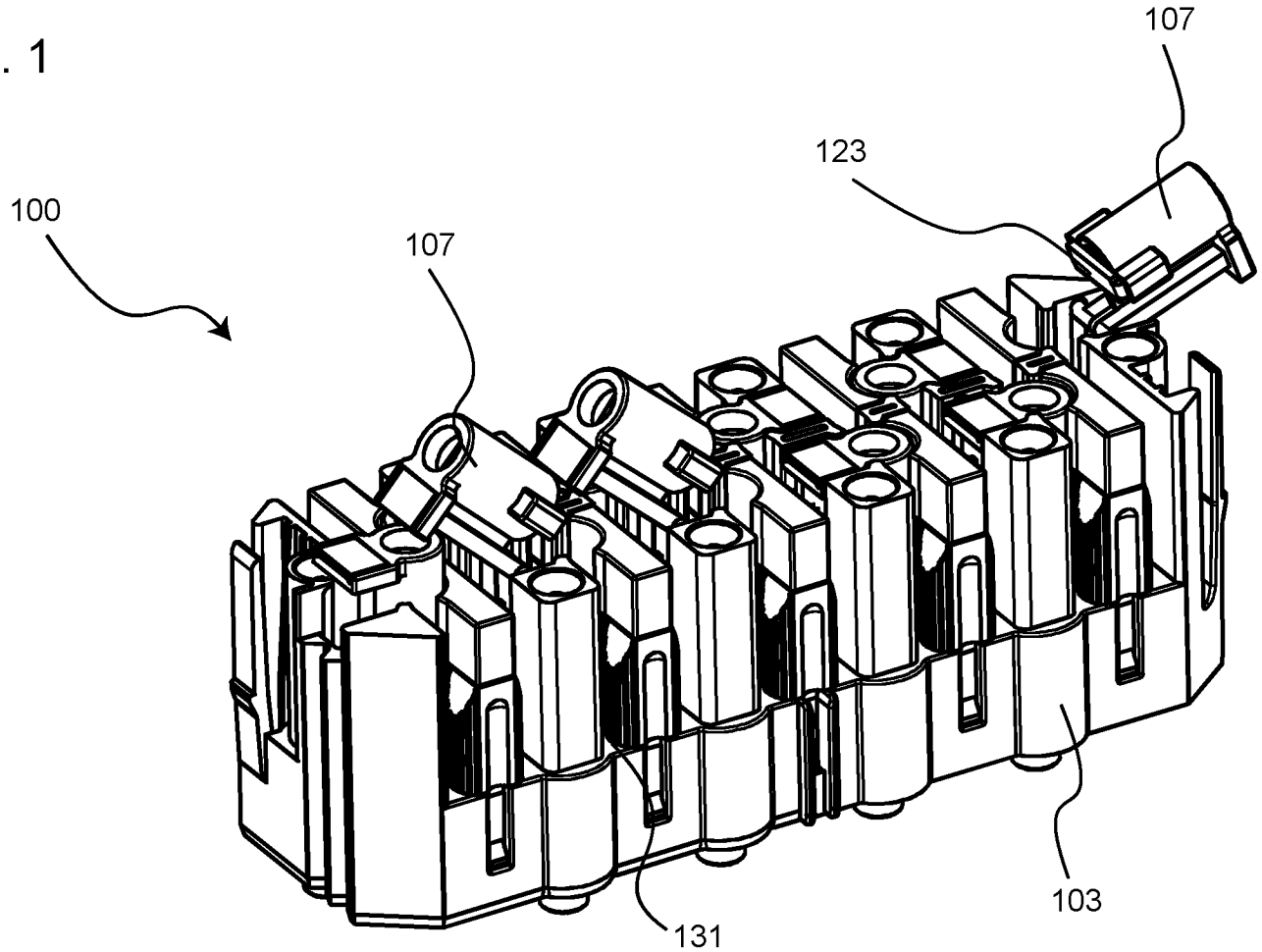
FIG. 1 shows a view of a connection device.

FIG. 1 shows a view of a connection device 100. The connection device 100 is used for electrically connecting electrical conductors and forms a clamp block with ten connections. For this purpose, the connection device 100 comprises multiple electrical connectors that are arranged in the interior of the connection device 100 in a specially designed contact carrier 103.

The electrical connectors comprise in each case a sheath clamp and a plug contact pin. The sheath clamp allows the connection of multiple non-terminated fine-wire conductors having different cross sections without limiting the visibility in an installation area. The contact carrier 103 comprises multiple sheath clamp openings 131, through which the electrical conductors run laterally into the contact carrier 103. The sheath clamp openings 131 are arranged on the side wall of the contact carrier 103. The contact carrier 103 is an insulating body that supports the retention of the bottom part of the sheath clamp and of the introduced electrical lines.

The sheath clamp comprises a bottom part of the sheath clamp and a top part of the sheath clamp that is screwed onto the bottom part of the sheath clamp. The electrical conductors are inserted between the bottom part of the sheath clamp and the top part of the sheath clamp, and pressed together so that an electrical contact is produced between the electrical conductors. The bottom part of the sheath clamp is arranged fixed and immobile in the contact carrier 103, whereas the top part of the sheath clamp is arranged rotatably in an insulating cap 107. The insulating cap 107 for the top part of the sheath clamp allows a free turning of the top part of the sheath clamp lying inside without the top part of the sheath clamp sliding out of the insulating cap 107. The insulating cap 107 is formed, for example, by an insulating plastic part that laterally surrounds the cylindrical top part of the sheath clamp.

The insulating cap 107 is attached to the contact carrier 103 in such a manner that it is permanently attached. The insulating cap 107 can be pulled out of the contact carrier 103 and then folded away to the side, so that the electrical conductors can be inserted from above into the contact carrier 103. As a result, a parking position of the insulating cap 107 is established in an open position that is open and does not hinder handling. On the contact carrier 103, any device that permanently attaches the top part 105-2 of the sheath clamp can be arranged. In addition, it can hold the top part 105-2 of the sheath clamp in defined parking positions in two assembly states.

For the securing of the electrical conductors, the insulating cap 107 is first tilted back into a vertical position and subsequently inserted into the contact carrier 103. Then, by means of a turning tool, the top part of the sheath clamp is screwed onto the bottom part of the sheath clamp, for example, by means of a slot screwdriver. To improve the contact between the electrical conductors, a contact bridge 123 is arranged on the bottom side of the insulating cap 107, which is pressed by the top part of the sheath clamp onto the electrical conductors.

Figure 2:
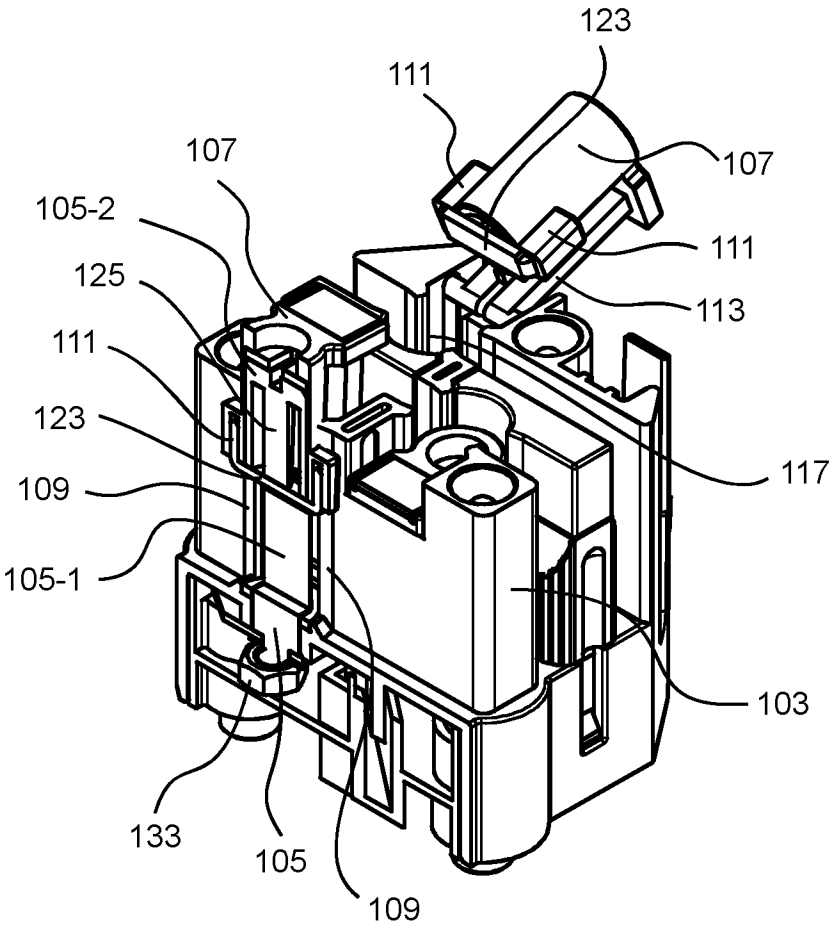
FIG. 2 shows an enlarged cross-sectional view of the connection device.

FIG. 2 shows an enlarged cross-sectional view of the connection device 100 with a section through the clamping site. The bottom part 105-1 of the sheath clamp is screwed to the contact carrier 103 by means of a nut 133, so that the bottom part 105-1 of the sheath clamp is arranged firmly in a manner and unrotatably in the contact carrier 103. The upper part 105-2 of the sheath clamp, on the other hand, is arranged rotatably in the insulating cap 107. The bottom part 105-1 of the sheath clamp and the top part 105-2 of the sheath clamp can be made of steel or brass.

The insulating cap 107 surrounds the top part 105-2 of the sheath clamp. The insulating cap 107 is inserted into the contact carrier 107. The insulating cap 107 comprises two laterally arranged protruding guide sections 111 for the insertion into the opposite guide grooves 109 of the contact carrier 103. Through the guide grooves 109, the insulating cap 107 can be slid in the interior of the contact carrier 103 in direction of the bottom part 105-1 of the sheath clamp.

The top part 105-2 of the sheath clamp comprises an inner threading which is screwed onto an outer threading of the bottom part 105-1 of the sheath clamp. In the pulled out state, the insulating cap 107 can be folded away to the side, so that the electrical conductors can be inserted from above into the contact carrier 103. For this purpose, the insulating cap 107 comprises a swivel arm 113, which is slidably attached by means of two pivots in a pivot guide groove 117. The swivel arm 113 extends parallel to the rotation axis of the upper part 105-2 of the sheath clamp in the insulating cap 107. When the insulating cap 107 is slid into the pivot guide groove 117, the pivots of the swivel arm 113 slide downward.

On the underside of the insulating cap 107, a contact bridge 123 is arranged, which, when the sheath clamp 105 is screwed together, presses against the inserted electrical conductors. In the center of the cylindrical top part 105-2 of the sheath, a peg 125 is arranged, which centrally supports the contact bridge 123. The contact bridge 123 can be inserted in the correct position via the insulating cap 107. The contact bridge 123 makes it possible to dispense with a rotatable internally spring-mounted pressure piece in the top part 105-2 of the sheath clamp. As a result, the manufacturing cost resulting from an internal spring mounting and the installation expenditure for the pressure piece can be dispensed with.

The result is a securing mechanism of the insulating cap 107 on the contact carrier 103 for the bottom part 105-1 of the sheath clamp. Above the bottom part 105-1 of the sheath clamp, a pre-engagement position of the top part 105-2 of the sheath clamp is provided for freeing up the adjacent clamping areas.

Figure 3:
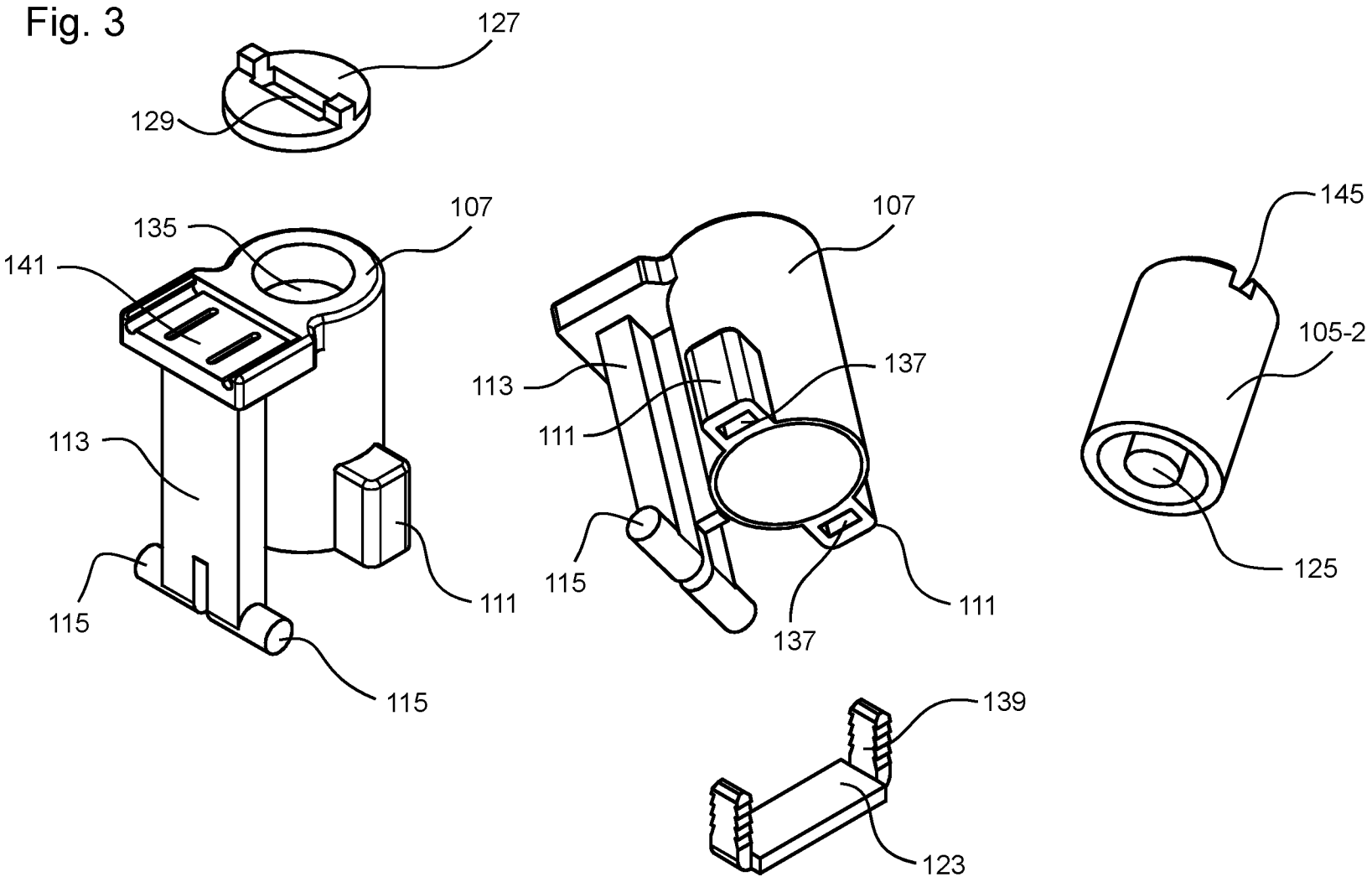
FIG. 3 shows different views of an insulating cap and a top part of a sheath clamp.

FIG. 3 shows different enlarged views of the insulating cap 107, of the top part 105-2 of the sheath clamp and of a contact protection element 127. The insulating cap 107 comprises the two laterally protruding guide sections 111. In the laterally protruding guide sections 111, in each case a recess 137 for the contact bridge 123 is provided. The bracket-shaped contact bridge 123 is pressed by means of the parallel arms 139 into the two recesses 137. The saw-tooth profile arranged on the arms 139 digs into the interior side of the recesses 137, so that the contact bridge 123 is secured to the insulating cap 107.

On the top of the side of the insulating cap 107 is an opening 135 through which the top part 105-2 of the sheath clamp can be turned. For this purpose, the top part 105-2 of the sheath clamp has a slot 145 into which a screwdriver can be inserted for turning the top part 105-2 of the sheath clamp. In addition, the insulating cap 107 comprises a marking recess 141 into which a marker or a label can be inserted.

On the side of the insulating cap 107, the swivel arm 113 is formed, on the lower end of which the two opposite pivots 115 are located. The swivel arm 113 extends parallel to the rotation axis of the inserted top part 105-2 of the sheath clamp. The pivots 115 of the swivel arm 113 are slidably inserted in a pivot guide groove 117, so that the insulating cap 107 can be slid inside the contact carrier 103 and can be tilted in a pulled out position.

Between a top side of the top part 105-2 of the sheath clamp and the insulating cap 107, the electrically insulating contact protection element 127 is inserted, which covers the top side of the top part 105-2 of the sheath clamp, except for the slot 129, so that a protection against contact is formed by a contact-safe insulation body covering. When the top part 105-2 of the sheath clamp turns, the contact protection element 127 also turns. The turning tool can be inserted through the slot 129 into the top part 105-2 of the sheath clamp.

Figure 4:
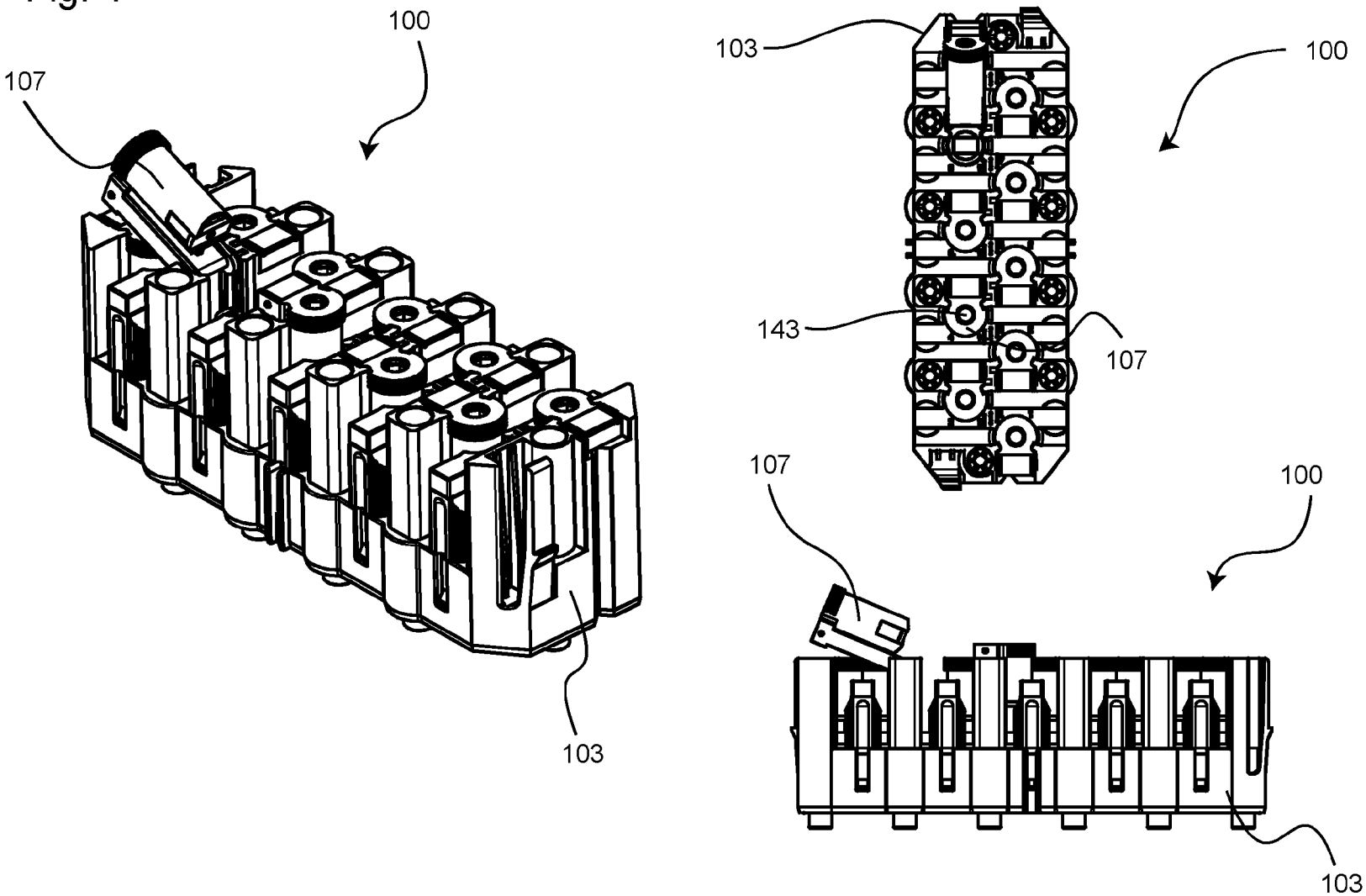
FIG. 4 shows a view of an additional embodiment of the connection device.

FIG. 4 shows a view of an additional embodiment of the connection device 100. In this embodiment, the top part 105-2 of the sheath clamp comprises a hexagonal recess 143 into which an Allen wrench can be inserted for turning the top part 105-2 of the sheath clamp. In this case, the contact protection element 127 can be dispensed with. In this embodiment as well, the insulating cap 107 follows and is subsequently folded away to the side in order to be able to insert the electrical conductors from above into the contact carrier 103.

Figure 5:
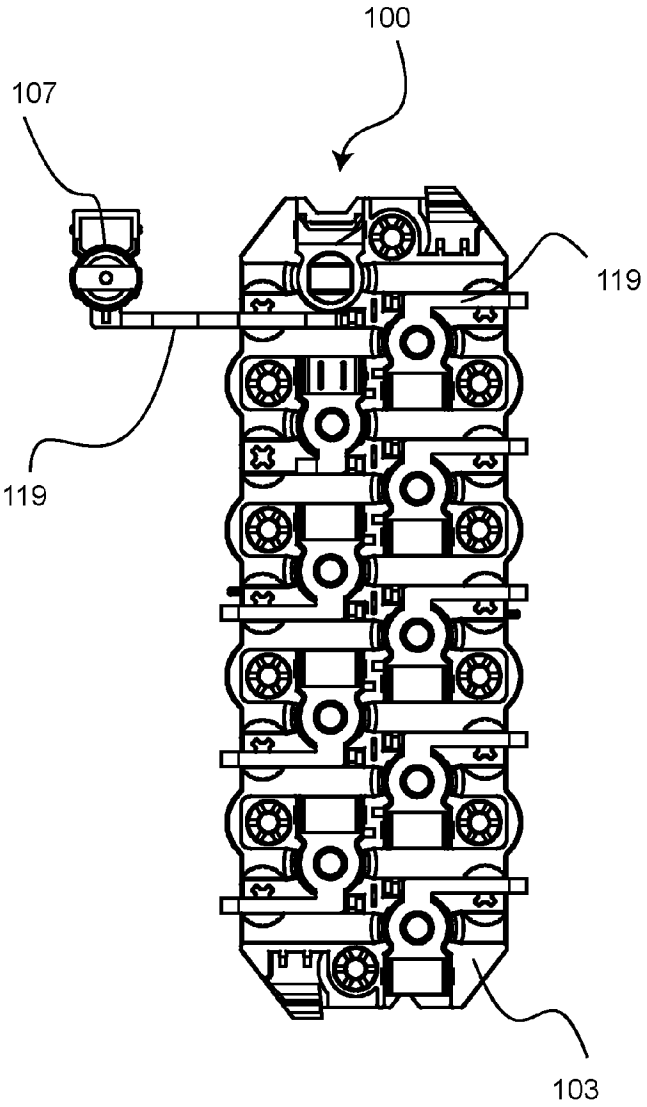
FIG. 5 shows a view of an additional embodiment of the connection device.
Figure 5:
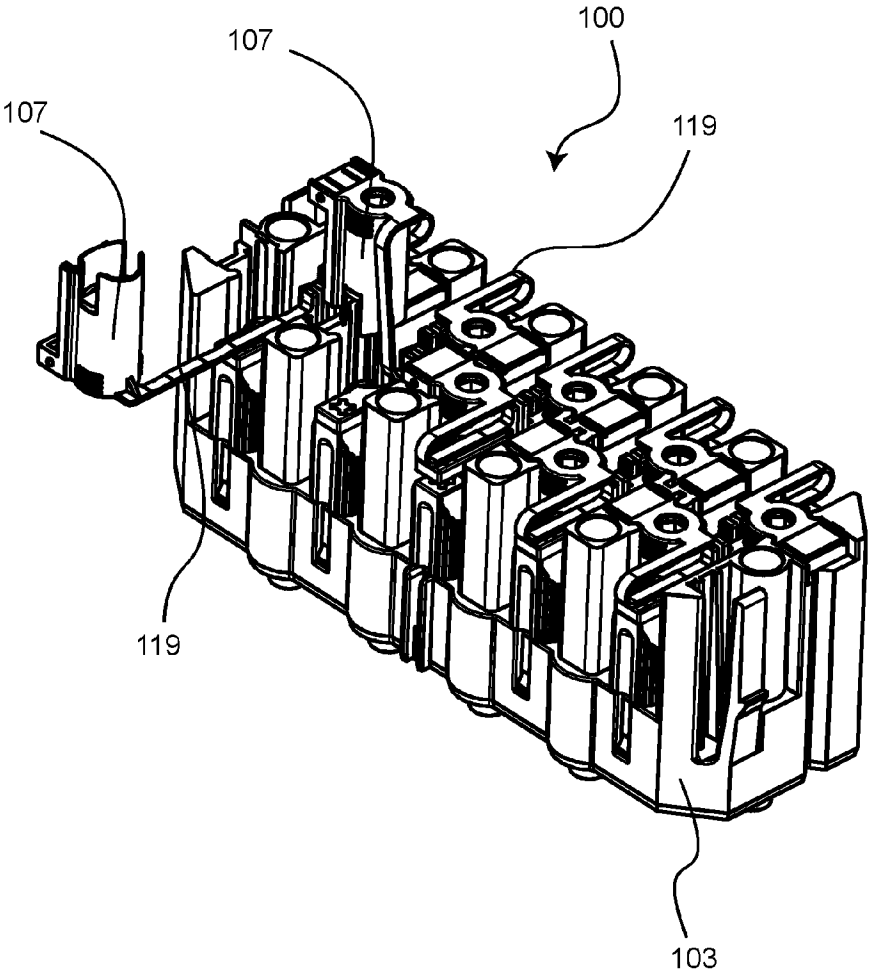

FIG. 5 shows a view of an additional embodiment of the connection device 100. In this embodiment, the insulating cap 107 is attached to the contact carrier 103 by means of a flexible section 119 such as, for example, by means of a small flexible band or a flexible plastic section. After the detachable pulling out of the insulating cap 107 from the contact carrier 103, the insulating cap 107 remains attached by means of the flexible section 119 to the contact carrier 103. After the insertion of the insulating cap 107, the insulating cap 107 can engage in a pre-engagement position for freeing up the adjacent clamping areas.

Figure 6:
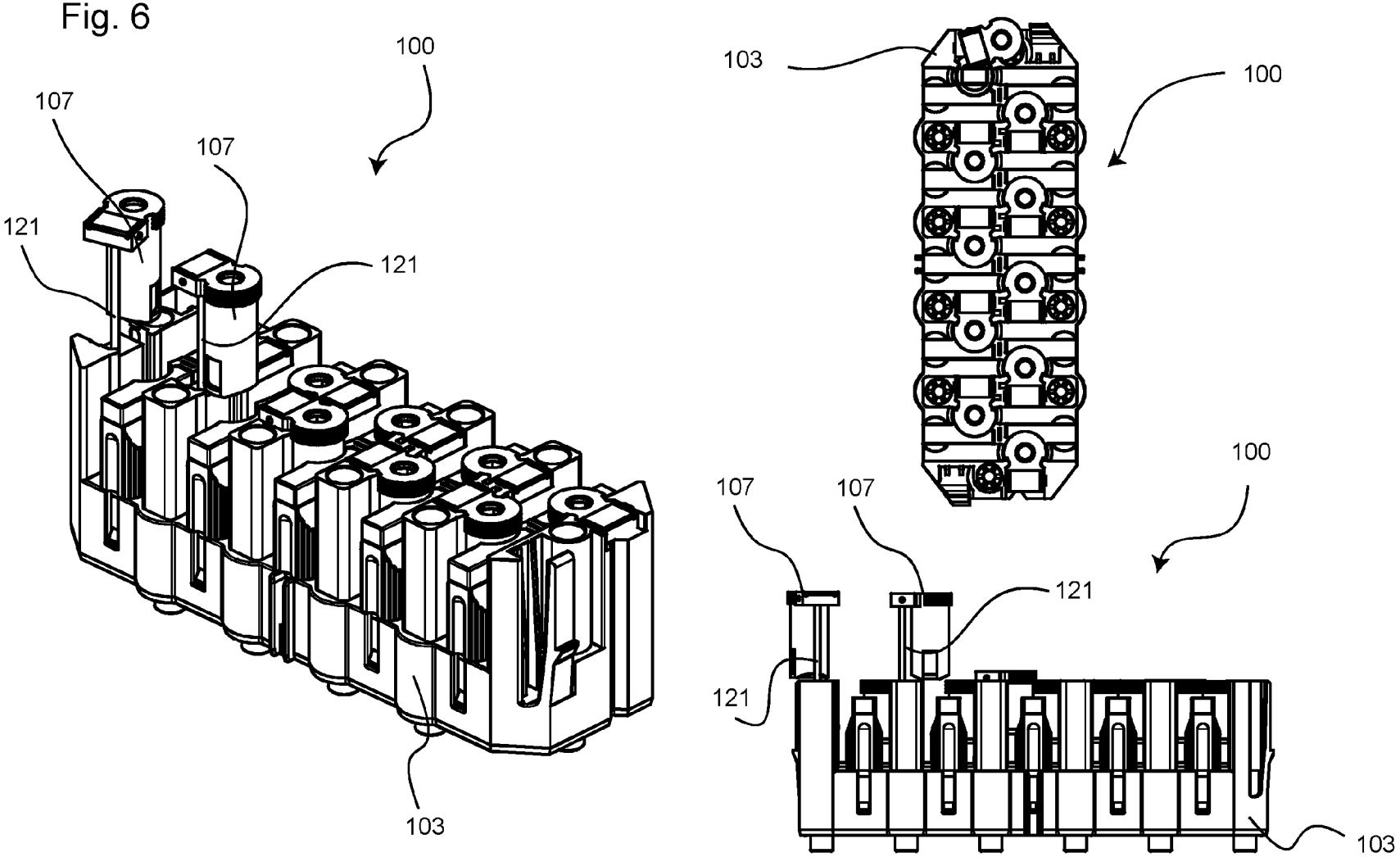
FIG. 6 shows a view of an additional embodiment of the connection device.

FIG. 6 shows a view of an additional embodiment of the connection device 100. In this embodiment, the insulating cap 107 comprises a pin 121 for rotatably attaching the insulating cap 107 to the contact carrier 103. The pin 121 extends parallel to the rotation axis of the top part 105-2 of the sheath clamp. After the insulating cap 107 has been pulled out, the insulating cap 107 together with the top part 105-2 of the sheath clamp can be turned away about the axis of the pin 121, in order to be able to insert the electrical conductors from above into the contact carrier 103.

The connection device 100 produces a connection solution with reduced loss and material for multiple fine-wire conductors which can also have different cross sections. The connection device 100 improves handling and increases the accommodation of the sheath clamp and of a riser clamp. The connection device 100 allows an integrated construction concept (Power & Drive—P&D), which attains the aim of a more efficient energy distribution in the field, i.e., outside of a switching cabinet.

The connection device 100 provides a handling advantage due to the possible use of smaller operating tools in the electrical installation. In addition, modular systems or motor switches, arranged inside or outside of a switching cabinet, can be implemented with a high degree of protection in the field.

All the features explained and shown in connection with individual examples can be provided in various combinations in the subject matter according to the present disclosure in order to simultaneously implement their advantageous effects.

The scope of protection of the present invention is given by the claims and is not limited by the features explained in the description or shown in the drawings.

REFERENCE NUMERAL LIST

100 Connection device
103 Contact carrier
105 Sheath clamp
105-1 Bottom part of the sheath clamp
105-2 Top part of the sheath clamp
107 Insulating cap
109 Guide groove
111 Guide sections
113 Swivel arm
115 Pivot
117 Pivot guide groove
119 Flexible section
121 Pin
123 Contact bridge
125 Peg
127 Contact protection element
129 Slot
131 Sheath clamp opening
133 Nut
135 Opening
137 Recess
139 Arms
141 Marking recess
143 Hexagonal recess
145 Slot

What is claimed is:

1. A connection device for connecting electrical conductors, comprising:

a sheath clamp comprising a bottom part of the sheath clamp and a top part of the sheath clamp;

a contact carrier to which the bottom part of the sheath clamp is attached; and a detachable insulating cap configured to hold the top part of the sheath clamp, wherein the top part of the sheath clamp is rotatable inside the detachable insulating cap, and wherein the detachable insulating cap is connected to the contact carrier via a flexible section, wherein the flexible section is formed from non-conductive material.

2. The connection device according to claim 1, wherein the insulating cap is insertable into the contact carrier.

3. The connection device according claim 1, wherein the contact carrier comprises two opposite guide grooves configured to guide the insulating cap inside the contact carrier.

4. The connection device according to claim 3, wherein the insulating cap comprises two guide sections configured for insertion in the opposite guide grooves of the contact carrier.

5. The connection device according to claim 1, wherein the insulating cap comprises a swivel arm configured for tiltable attachment of the insulating cap to the contact carrier.

6. The connection device according to claim 5, wherein the swivel arm comprises two opposite pivots.

7. The connection device according to claim 6, wherein the contact carrier comprises two pivot guide grooves configured for slidable insertion of the insulating cap by means of the opposite pivots.

8. The connection device according to claim 1, wherein the insulating cap comprises a pin configured for rotatable attachment of the insulating cap to the contact carrier, wherein the pin extends parallel to a rotation axis of the top part of the sheath clamp.

9. The connection device according to claim 1, wherein a metal contact bridge is attached to the insulating cap and configured to exert a pressing force onto the electrical conductors.

10. The connection device according to claim 9, wherein the metal contact bridge is attached to one or more guide sections of the insulating cap.

11. The connection device according to claim 9, wherein the metal contact bridge overlaps the top part of the sheath clamp.

12. The connection device according to claim 9, wherein the top part of the sheath clamp comprises a peg configured to exert a pressing force onto the metal contact bridge, wherein the peg is arranged on a rotation axis of the top part of the sheath clamp.

13. The connection device according to claim 1, wherein an electrically insulating contact protection element is arranged between a top side of the top part of the sheath clamp and the insulating cap.

14. The connection device according to claim 13, wherein the contact protection element comprises a slot configured for insertion of a turning tool.

15. A connection device for connecting electrical conductors, comprising:

a sheath clamp comprising a bottom part of the sheath clamp and a top part of the sheath clamp;

a contact carrier to which the bottom part of the sheath clamp is attached; and a detachable insulating cap configured to hold the top part of the sheath clamp, wherein the top part of the sheath clamp is rotatable inside the detachable insulating cap, and wherein the detachable insulating cap is connected to the contact carrier, wherein a metal contact bridge is attached to the insulating cap and configured to exert a pressing force onto the electrical conductors.

16. The connection device according to claim 15, wherein the metal contact bridge is attached to one or more guide sections of the insulating cap.

17. The connection device according to claim 15, wherein the metal contact bridge overlaps the top part of the sheath clamp.

18. The connection device according to claim 15, wherein the top part of the sheath clamp comprises a peg configured to exert a pressing force onto the metal contact bridge, wherein the peg is arranged on a rotation axis of the top part of the sheath clamp.

* * * * *